US007810176B2

(12) United States Patent
Turner

(10) Patent No.: US 7,810,176 B2
(45) Date of Patent: Oct. 12, 2010

(54) COMPACT DRAIN-CLEANING DEVICE WITH HAIR-SNAGGING PAD

(76) Inventor: Scott I. Turner, P.O. Box 274, Chillicothe, IL (US) 61523

( * ) Notice: Subject to any disclaimer, the term of this patent is extended or adjusted under 35 U.S.C. 154(b) by 0 days.

(21) Appl. No.: 12/553,245

(22) Filed: Sep. 3, 2009

(65) Prior Publication Data

US 2009/0320197 A1 Dec. 31, 2009

Related U.S. Application Data

(62) Division of application No. 10/899,979, filed on Jul. 27, 2004, now Pat. No. 7,584,513.

(51) Int. Cl.
*E03D 9/00* (2006.01)

(52) U.S. Cl. ..... 4/255.01

(58) Field of Classification Search ..... 4/255.01, 4/255.07, 255.08, 286; 15/104.001, 104.005, 15/104.32, 104.33, 105; D8/19
See application file for complete search history.

(56) References Cited

U.S. PATENT DOCUMENTS

| | | | |
|---|---|---|---|
| 3,330,533 | A | 7/1967 | Blume |
| 3,370,853 | A | 2/1968 | Feld et al. |
| 4,774,739 | A | 10/1988 | Sherman, Jr. |
| 4,825,477 | A | 5/1989 | Aranda |
| 5,251,339 | A | 10/1993 | Piskula |
| 5,765,251 | A | 6/1998 | Jones |
| 5,769,960 | A | 6/1998 | Nirmel |

(Continued)

FOREIGN PATENT DOCUMENTS

| | | | |
|---|---|---|---|
| GB | 2246698 | A | 2/1992 |

(Continued)

OTHER PUBLICATIONS

Cobra Products, Zip-it Series 00-400, Cobra Products online catalog, http://www.cobraus.com/tools.asp?TypeID=6, Jul. 18, 2004, USA.

(Continued)

*Primary Examiner*—Tuan N Nguyen
(74) *Attorney, Agent, or Firm*—Charles S. Sara, Esq.; Dewitt Ross & Stevens, S.C.

(57) ABSTRACT

A compact, smooth surfaced, flexible and formable, elongate apparatus that has a hair-clog snagging end portion for insertion into drains for snagging and removing the common hair clogs that exist in the upper portion of drains typically around the drain pop-up mechanism and drain trap. The elongate shaft (10) may be bent along its complete length into any shape and remain fixed in that shape to accommodate compact storage as well as forming a grasping and twisting handle for the shaft while it is in the drain or bending the hair-snagging end of the shaft for easier insertion and navigation within the drain. The hair-clog snagging portion, which is at the distal end of the shaft, is in the form of a pad (12), which maximizes the surface area of hair hooking members (38). The hair-snagging pad consists of the hook portion of hook-and-loop fasteners and contains a multitude of miniature, hook formed, polymeric elements which aggressively entangle hair-clogs for quick retrieval from the drain without dismantling the drain and without using dangerous chemicals in the drain.

20 Claims, 7 Drawing Sheets

U.S. PATENT DOCUMENTS

| | | | |
|---|---|---|---|
| 5,836,032 | A | 11/1998 | Hondo |
| 6,131,229 | A | 10/2000 | Lincuna |
| 6,238,358 | B1 | 5/2001 | Philot |
| 6,298,514 | B1 | 10/2001 | Lazich et al. |
| 6,920,663 | B2 | 7/2005 | Petit |
| D511,278 | S | 11/2005 | Carfagnini |
| 7,584,513 | B2 | 9/2009 | Turner |

FOREIGN PATENT DOCUMENTS

| | | | |
|---|---|---|---|
| GB | 2281112 | A | 2/1995 |
| GB | 2351013 | A | 12/2000 |
| WO | WO0248471 | A1 | 6/2002 |

OTHER PUBLICATIONS

Superior Tool, New Products-Drain Stick, Superior Tool online catalog, http://www.superiortool.com/whatsnew.htm, USA.

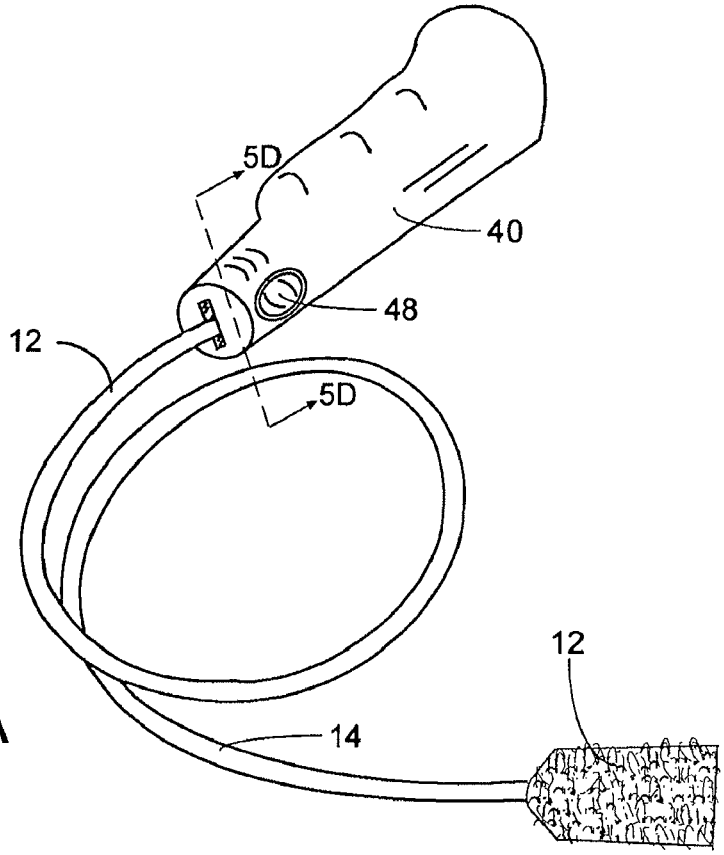
FIG. 5A
FIG. 5B
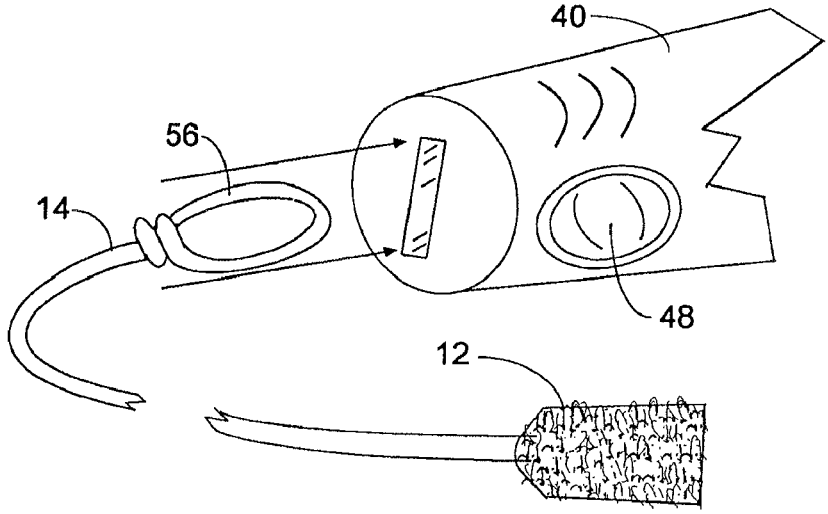

COMPACT DRAIN-CLEANING DEVICE WITH HAIR-SNAGGING PAD

CROSS-REFERENCE TO RELATED APPLICATIONS

This is a divisional of application Ser. No. 10/899,979, filed Jul. 27, 2004 now U.S. Pat. No. 7,584,513, the entirety of which is incorporated herein by reference.

FIELD OF THE INVENTION

The present invention pertains to general cleaning devices and more specifically to snake and grapple devices for retrieving and cleaning hair clogs from sanitary drainpipes in sewer lines.

DESCRIPTION OF THE PRIOR ART

Many devices exist in the field of the present invention that fulfill countless objectives with respect to cleaning sewer lines and drainpipes. None however fulfill the need for a safe and inexpensive device that is compact and effective in retrieving hair clogs from the upper portions of drainpipes found in the average home which are connected to sinks, tubs and showers.

A common problem that plagues people that use modern plumbing is the inevitable development of clogs that develop in the drainpipes connected to sinks, bathtubs and showers. These clogs may result from objects accidentally being dropped down a drain, but more typically are the result of a build-up of the soaps, oils, greases, hair and other organic material that is washed down the drain. Individuals skilled in the art and even the average homeowner are familiar with devices and methods used to try to open clogged drains. These include flexible plungers, metal plumber's snakes and numerous chemical and biological substances readily available in supermarkets and hardware stores. Plungers use air and water pressure to push and pull at the clog to dislodge it and allow it to freely flow out of the pipe and into the sewer system. Snakes are typically coils of flattened metal with a spiral wire on the end that are inserted into the drain to break through a clog by forcibly pushing, pulling and twisting to mechanically degrade the clog and allow it to flow freely into the sewer system. Chemical liquids and crystalline sodas chemically react with the clog, degrading or liquefying it until it flows freely into the sewer system.

These devices are often effective in freeing clogged drains but do not offer a consistent solution to opening clogged drains that are largely a result of an accumulation of hair that typically occurs in the trap and especially hair that becomes entangled in the drain pop-up lever arm assembly just below the drain pop-up in the opening of the drain. The current invention departs from concepts and designs of the prior art by embodying a device that is compact and capable of reliably and effectively removing such hair clogs from the upper portions of drains.

Each device of the current art is seen to be deficient in providing a solution for these upper-drain hair clogs upon examination. Plungers that utilize air or water pressure to dislodge clogs in drains do not reliably dislodge hair clogs because the pressurized air or water force is not great enough to break hair away from solid, fixed protrusions within the drainpipe. The hair that is entangled around a fixed object primarily the drain pop-up lever arm is a case in point. In addition, the hair that has become embedded in encrustment or build-up that has accumulated within the pipe in the drain trap or along the pipe wall are additional examples.

The common plumber's snake is another device of the prior art that is effective in breaking up drain clogs by repeated forcible insertion and retrieval of the device in the drain. These however have the drawbacks of being large and unwieldy for the average homeowner and often cannot be used for upper-drain clogs or those occurring from the drain opening to the trap because the drain opening around the peripheral area of the drain pop-up of a sink is not large enough to accommodate the metal spiral end of the snake. Smaller spiral-tipped sink snakes are available but still very unwieldy and not adept at snagging hair entangled around the drain pop-up lever arm. In addition, most of these devices are metal and subject to rust and corrosion. Specialized upper-drain snake devices do currently exist in the prior art, and in the marketplace, which are designed to be small enough to fit past the drain stopper in the drain opening of the typical sink. These devices each have disadvantages not present in the present invention. They are either unsafe for the user because of sharp edges, or have wire hooks which can get hooked on the pop-up lever arm, or they are not compact making them inconvenient to store or transport. These devices usually have length and cannot be coiled in a stationary fashion, which means a homeowner cannot store them in a drawer or the artisan cannot transport then in a toolbox due to their length. This is also a disadvantage in commercial sale since these devices cannot readily be packaged with the shelf size drain products that they work hand-in-hand with to provide a complete drain cleaning solution. These devices also have fewer hair-snagging elements than the present invention reducing their ability to snag, and hold, drain hair by comparison.

Homeowners typically resort to caustic chemical products to open clogged drains. These are often effective in chemically "burning away" drain clogs but have the disadvantages of being dangerous to people, pets and the environment. The caustic ingredients in these remedies often contain sodium hypochlorite (bleach), sodium hydroxide (lye) or acid. These chemicals are responsible for a multitude of human poisonings annually as well as eye, lung and flesh injuries from their use and existence in the household. These chemicals are readily available in most all grocery and hardware stores and are the easiest for the homeowner to use. Consequently the large, cumulative volume that enters our sewage systems represents a hazard to the environment as the chemicals are not readily broken down in sewage treatment plants and flow out into the environment adding unwanted and detrimental pollutants. In addition, the chemical solutions often flow by hair clogs that are wrapped around the drain pop-up lever arm and are suspended in the center of the drainpipe where the liquids cannot effectively work on them.

Biological drain opening products are also readily available to homeowners in stores and also represent an easy-to-use drain maintenance solution for homeowners. They typically come in a liquid or powder form that the homeowner simply washes down the drain similar to chemical products. These solutions have the benefit of ease of use without the danger of injury to people, pets and the environment. They work by utilizing natural and harmless live bacteria and enzymes that feed on the organic drain refuse and break it down to base elements in the same way that nature recycles refuse in the environment. These types of products hold out the hope of effective drain maintenance for the individual diligent in home maintenance and family safety. They also represent a benefit to society by replacing the chemicals that cause injury to people and damage to the environment. Unfortunately one drawback of biological products is that they are less effective for rapid treatment of hair-clogged drains. By not being able to readily free slow flowing drains due to hair clogs, biological drain products are less popular in the marketplace and consequently consumers more frequently purchase the dangerous and harmful chemical products to open drains to the detriment of society in general.

The present invention plays a vital role in solving the societal problem of using injurious caustic chemical drain opener products. It fulfills the need for a compact device for effectively clearing drain hair clogs. As a stand-alone device it fulfills the need for a safe, effective and easily stowable device for a homeowner to immediately and easily open up a slow-running, hair-clogged drain by retrieving the hair clogs that often occur in them.

The present invention also fills a void that currently exists in the prior art by representing a device that enhances and facilitates the use of people-friendly and environment-friendly biological drain maintenance products. By providing a compact and inexpensive device for clearing the hair clogs that biological products do not effectively eliminate, the present invention can readily be packaged with these products making them a more effective and attractive solution to opening clogged drains without the societal problem of exposing people to dangerous chemicals and harming the environment. Nothing found in the prior art or the marketplace combines the attributes of compactness, safety to the user and hair-snagging effectiveness like that of the present invention.

Consequently, the present invention represents a substantial departure from all the current concepts and designs in the prior art and includes many novel features and embodiments resulting in a new device for cleaning hair clogs from drains.

OBJECTS AND ADVANTAGES

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially those skilled in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Accordingly, there are several objects and advantages of the present invention.

(a) It is an object of the present invention to provide a device for removing drain clogs that consist primarily of hair and other fibrous matter from the upper portions of drains from the drain opening to the trap where they typically form.

(b) It is another object of the present invention to provide a new and novel device for removing hair and other fibrous clogs from the upper portions of drains which combines attributes in a fashion that has not previously been anticipated, rendered obvious or even been previously implied by any of the crowded prior art of drain cleaning devices.

(c) It is also an object of the present invention to provide a device for removing hair and fibrous clogs that is easy and safe to use for both the average homeowner or artisan and which is inexpensive and affordable, and easily manufactured from existing products and materials.

(d) It is another object of the present invention to provide a device for removing hair and fibrous clogs from a drain that does not harm the environment or present a health hazard in the household or for the artisan.

(e) Another object of the present invention is to provide a device for removing hair and fibrous clogs that has a hair-snagging element at the distal end of an elongate shaft that is in the form of a pad which has width and thickness dimensions that allow it to fit into the drain opening through one of the four pie-shaped openings at the peripheral area of the drain pop-up stopper. This pad is not limited in shape but in the preferred embodiment of the device is manifested in the shape of a modified rectangle and made from readily available and inexpensive sections of the polymeric hook portion of hook-and-loop fastener material. The rectangular surface area of the hair-snagging pad has the end result of presenting the maximum number of hair-snagging hook elements on both the front and back side of the pad that the drain opening can accommodate. Hook-and-loop material is well known for its tenacious ability to snag and hold the loop portion of the fastener, providing the significant sheer strength or pull strength needed to pull loose and retrieve an entangled hair clog in a drain. Fibrous drain-hair clogs are similar in nature to this loop material and consequently also snag and hold tenaciously to the hair-snagging pad at the distal end of the present invention. The distinctive, rectangular shape of the pad has a wide sweeping range to snag hair when maneuvered and rotated within the drain. The hair-snagging pad in the preferred embodiment of the present invention utilizes the width of the flattened pad to present more hair-snagging hook elements against the clog and has an advantage over the prior art as stated in U.S. Pat. No. 5,836,032 issued to Hondo on Nov. 17, 1998. That device is not compact and is limited in the number of hooking elements presented to the clog since they are arranged radially around the elongate shaft which itself is limited in diameter to fit the largest circular dimension of the pie-shaped opening of the drain around the peripheral area of the drain pop-up stopper. The flattened hair-snagging pad of the present invention maximizes use of the widest lateral dimension of the drain opening rather than its smaller circular dimension. This consequently represents an advantage not contemplated in prior art providing a very effective device for removing hair clogs from drains while utilizing existing, inexpensive, tried-and-proven materials used in a new and novel way.

(f) Another object of the present invention is to provide a device for removing hair and fibrous clogs that is compact by having a construction that is capable of easily being bent and formed into pocket-sized, fixed shapes such as a coil. This has a distinct advantage in the field of specialized, upper-drain snake devices of being more easily stored, transported and packaged for sale either alone, in multiple quantities, or in combination with other related drain care products.

(g) It is another object of the present invention to provide a device for removing hair and fibrous clogs from a drain that can reduce the use of dangerous chemical drain openers and enhance the use of safe, biological drain cleaning products by being of such a compact size that it may be easily packaged with these safer types of off-the-shelf products.

(h) Yet another object of the present invention in its preferred embodiment is to provide a device for removing hair and fibrous clogs that has all exposed parts made from plastic materials and not subject to rust or corrosion like metal snakes, and which is capable of either being cleaned and reused or simply disposed of due to its low cost.

(i) Another object of the present invention is to provide a device for removing hair and fibrous clogs that due to its construction can be bent and remain fixed into many shapes. For the grasping, proximal end it may be formed for example into a circular, T-shaped or Z-shaped configuration to facilitate the pushing, pulling and rotating motion that is required to maneuver the hair-snagging distal end of the device into the drain and down to the fibrous clog.

(j) Another object of the present invention is to provide a device for removing hair and fibrous clogs that has exterior surfaces made from plastic materials which are free of sharp edges making it safe for the untrained user or artisan.

(k) Another object of the invention is to provide a device for removing hair and fibrous clogs that has effective hair-snagging ability without using metal hooks which tend to get snagged onto the drain pop-up apparatus within the drain when attempting to maneuver the device to snag hair clogs. Also, by utilizing polymeric hook-and-loop type material, the present invention is safer for the user than wire hook devices.

Further objects and advantages of the present invention will become apparent from a consideration of the drawings and ensuing description.

SUMMARY OF THE INVENTION

The present invention is a device for quickly retrieving hair and other fibrous waste from a drain without dismantling the drain and without using dangerous chemicals in the drain and which comprises an elongate shaft, which flexes into fixed bent positions, having a proximal end portion for grasping and a distal end portion for insertion into a drain. In the preferred embodiment, the shaft is comprised of a plastic sheathed metal wire, which maintains a fixed position when bent allowing the device to be shaped into compact designs for ease of storage, transport and packaging as well as allowing various shapes to be bent at the proximal end to serve as a grasping and rotating handle. The device also includes a hair-snagging member which is securely attached at the distal end of the elongate shaft which is a flat, double-faced pad or pouch made from attaching two strips of the hook portion of common hook-and-loop material back-to-back. The resulting pad or pouch may be of various sizes and shapes but, in the preferred embodiment, has a predetermined length and width, which is determined by the longest lateral dimension of the pie-shaped opening created along the side of the drain pop-up stopper. By exploiting the thinner but wider dimension of the drain opening, the present invention departs from devices of the prior art which typically provide hooking materials disposed radially from the smaller dimensioned circular shaft of the device. This novel use of common hook-and-loop material in a double-sided, modified rectangular shape maximizes the hooking member surface area allowing over 300 hooking members per vertical inch of pad to be presented against the drain hair-clog and creating a larger sweep circumference within the drain when the shaft and pad are rotated via twisting the grasping proximal end of the shaft. This multitude of hooking members efficiently snag drain hair and fibrous material since those elements are very similar in nature to the loop portion of hook-and-loop material, creating entanglement on contact with the clog and having the increased holding strength that is necessary to withdraw drain hair and fibrous matter which becomes tenaciously entangled around the drain pop-up mechanism and in the drain trap.

The objects and advantages of the invention will appear more fully from the following detailed description of the preferred embodiment of the invention made in conjunction with the accompanying drawings.

BRIEF DESCRIPTION OF THE DRAWINGS

The invention will be better understood and objects other than those set forth above will become apparent when consideration is given to the following detailed description. The description makes reference to the attached drawings wherein:

FIG. 5A is a perspective view of yet another embodiment of this invention showing the hair-snagging pad and wire shaft as disposable members with a removable handle.

FIG. 5B is a close-up end view of the embodiment of FIG. 5A showing the method of inserting and removing the disposable wire with pad member into the removable handle.

DETAILED DESCRIPTION OF THE INVENTION

The invention for removing hair and fibrous clogs from drainpipes is best understood by reference to the attached drawings.

Preferred Embodiment

FIG. 1A

Figure 1A:
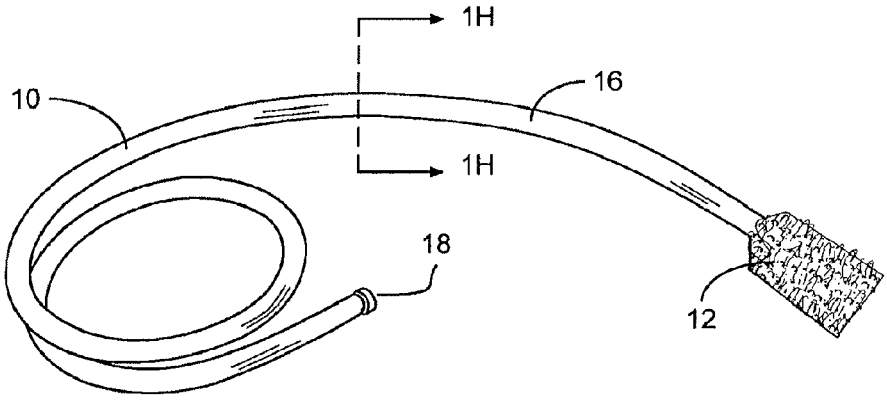
FIG. 1A is a perspective view of the preferred embodiment of this invention.
Figure 1B:
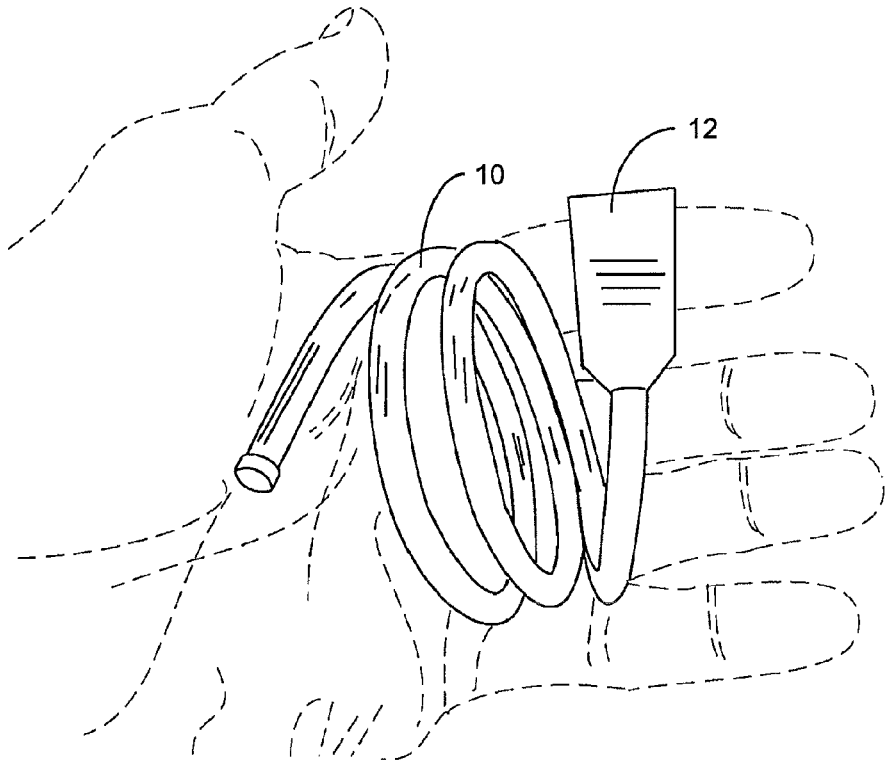
FIG. 1B is a perspective view of the preferred embodiment bent into a fixed coil shape showing its compact handheld size for storage and packaging.
Figure 1C:
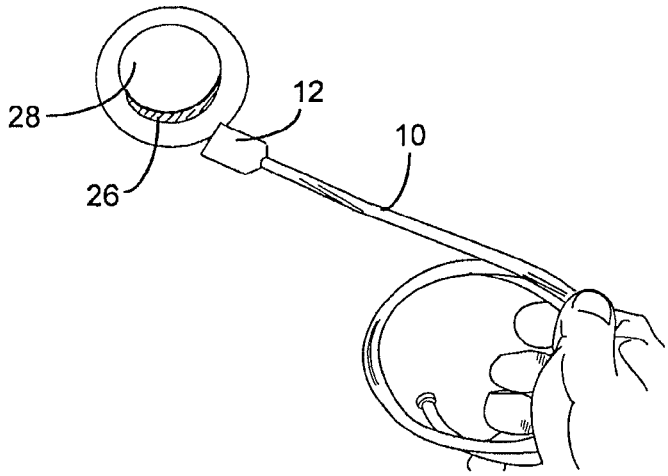
FIGS. 1C-1E are top elevations showing the method of use of the preferred embodiment of FIG. 1A of the invention. The embodiments of FIGS. 2, 3, 4A and 5A would be operated in a similar fashion.
Figure 1D:
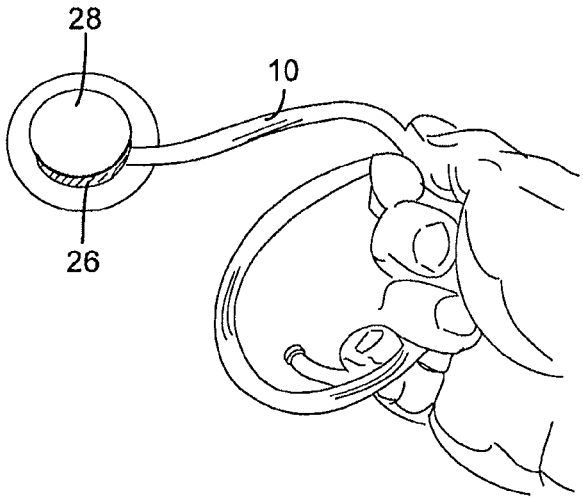
Figure 1E:
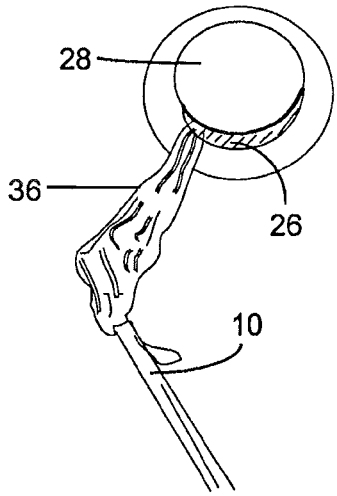
Figure 1F:
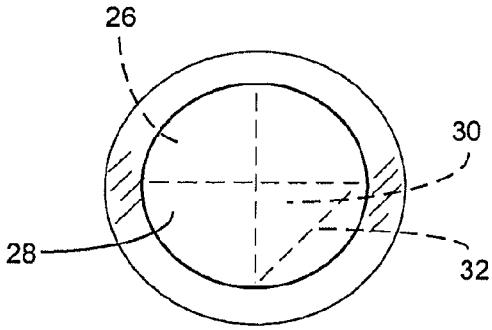
FIG. 1F is a perspective top view of a typical drain opening and pop-up stopper showing the pie-shaped drain openings and the optimum insertion angle for the invention.
Figure 1G:
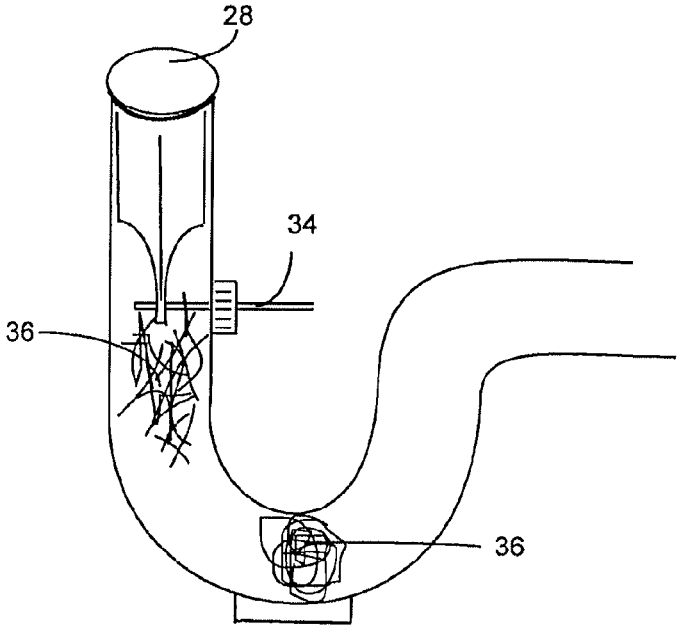
FIG. 1G is a side sectional view of a typical drain and trap showing where hair clogs typically accumulate.
Figure 1H:
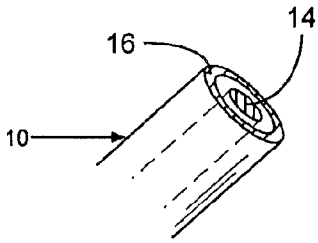
FIG. 1H is a cross-sectional close-up view of the elongated shaft of the preferred embodiment of this invention.
Figure 1J:
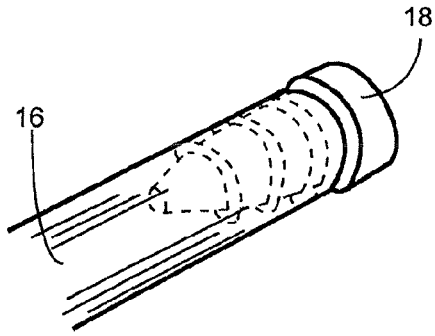
FIG. 1J is a close-up view of the plastic plug, which is inserted in the proximal end of the sheath covering of the elongated shaft of the preferred embodiment of this invention.

FIG. 1A shows a perspective view of the preferred embodiment of the invention. The shaft 10 of the device consists of a plastic sheath 16 made from common 3/16" OD PVC plastic tubing with a 90 Shore A durometer hardness with a #16 galvanized wire 14 inserted inside. FIG. 1H is a sectional view of the shaft 10 perpendicular to the longitudinal axis of the shaft 10. The shaft 10 may be of any length but in the preferred embodiment is approximately 61 cm or 24 inches to reach past the typical drain trap. The wire 14 is sealed inside the sheath 16 with a readily available plastic, barbed plug 18 in FIG. 1J that is inserted into the grasping, proximal end of the shaft. The wire 14 shown if FIG. 1H gives the device enough rigidity for pushing into drains. The distal end of the sheath 16 is heat-sealed into a flattened, bell shape (not shown) and inserted into the hair-snagging pad 12 shown in FIG. 1A. The hair-snagging pad 12 consists of two matching pieces of the hook portion of common hook-and-loop fastener material. The two pieces are fastened at the edges back-to-back into a pad or pouch 12. The two pieces of hook material may be thermally attached, attached with adhesive or mechanically attached together with eyelets, rivets or similar fasteners (not shown). The flattened, distal end of sheath 16 is inserted into the pouch 12 and the pouch 12 is then sealed around the flattened, bell-shaped distal end (not shown) of the sheath 16 resulting in a pad 12. The resulting pad 12 has hooking members 38 on both exposed, substantially flat surfaces of the pad 12 as seen in the side elevation view in FIG. 1K. The pad 12 may be many different shapes, colors and sizes but in the preferred embodiment is 15.88 mm by 25.4 mm or 5/8" by 1" and approximately shaped into a modified rectangle with approximately 300 hooking members 38 total on both sides of the pad 12. This width dimension is maximized to fit the typical sink drain opening 26 which is often restricted by a pop-up stopper 28 as shown in FIGS. 1F and 1G, which is installed at the opening of the drain. As seen in FIGS. 1F and 1G, the pop-up 28 body segments the drain opening into 4 smaller, pie-shaped openings 30. By designing the invention with a substantially flat, rectangular shaped snagging pad 12, it is able to slide past the pop-up stopper 28 at an oblique insertion angle 32 with respect to the circumference of the drain opening as shown by the diagram in FIG. 1F.

Additional Embodiments

FIG. 1L

Figure 1K:
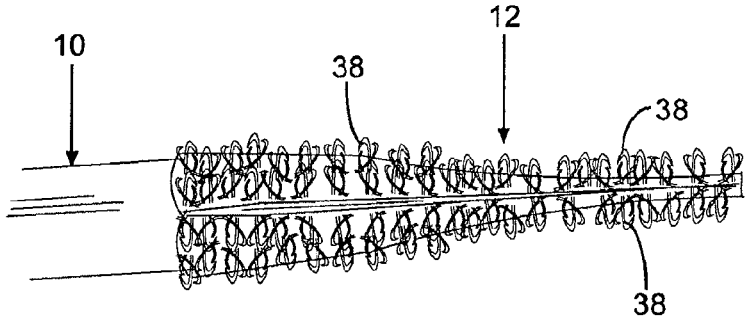
FIG. 1K is a close-up side elevation view of the hair-snagging pad showing the hooking members disposed at the distal end of the elongated shaft of all the embodiments of this invention.
Figure 1L:
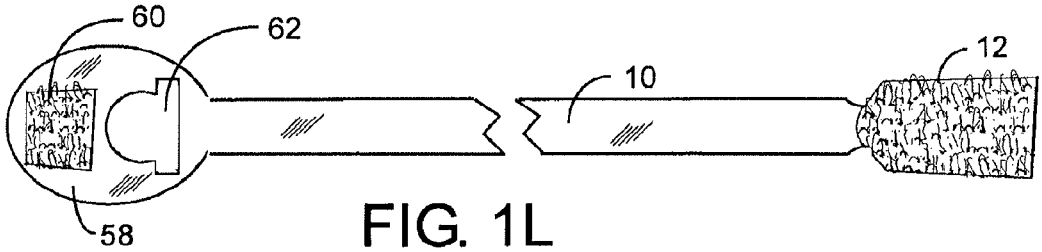
FIG. 1L is a perspective view of another embodiment of this invention, which shows how the device may be made with an all-plastic shaft.

FIG. 1L shows another, simplified embodiment of the present invention. This version maintains the novel features of being a compact device, and having a shaft 10 capable of being coiled along with a hair-snagging pad 12, but is made even more inexpensively by having a molded plastic shaft 10 with grasping member 58 located at the proximal, grasping end, and the same unique hair-snagging pad 12 disposed at the distal end of the device. The hair-snagging pad 12 consists of two matching pieces of the hook portion of common hook-and-loop fastener material. The two pieces are fastened at the edges back-to-back into a pad or pouch 12. The two pieces of hook material may be thermally attached, attached with adhesive or mechanically attached together with eyelets, rivets or similar fasteners (not shown). The molded plastic shaft has a T-shape (not shown) at the distal end, which is inserted into the hair-snagging pad 12. This T-shape provides pull-out resistance from within the sealed pad or pouch 12. The device in this embodiment is designed to be disposable after use and may be purchased economically in quantities for the home, institutional, or artisan user. The device as represented in this embodiment does not have a metal or wire core to maintain the fixed, coiled position necessary for ease of storage, transport and packaging. Consequently, it may also have a piece of the loop portion of common hook-and-loop material attached to the grasping member 58 to create a coiling fastener pad 60 such that when coiled by inserting through the grasping member 58, and specifically through the coiling slot 62, after 2 loops, the pad 12 wraps around and sticks to the attached piece of loop material and the device maintains a coiled configuration. The invention as represented in this embodiment may also be made from metal, however only for high volume, non-consumer users who are properly equipped with protective gloves due to the possibility of sharp edges and injury to the user.

Additional Embodiments

FIG. 2

Figure 2:
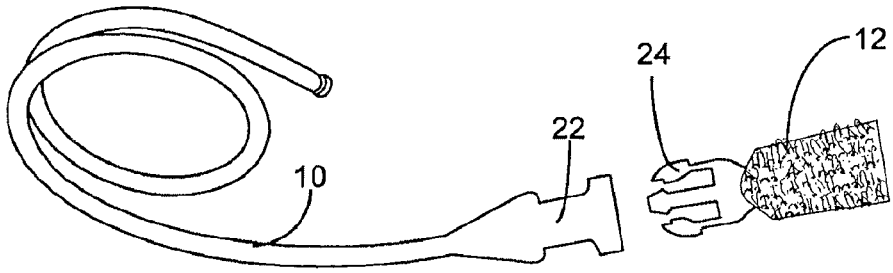
FIG. 2 is a perspective view of another embodiment of this invention, which shows how a quick-release catch mechanism is used to create a removable and disposable hair-snagging pad.

FIG. 2 shows another embodiment of the present invention. This variation of the inventive device maintains the novel features of the preferred embodiment including a substantially flat, hair-snagging pad 12 and also a flexible shaft 10 which may be bent into compact fixed positions such as a pocket-sized coil. In this embodiment, the shaft 10 is made from molded plastic which may or may not have a wire core, and the hair-snagging pad 12 is sealed around the distal end of the male member of a catch mechanism 24 resulting in a pad 12 and catch 24 combined unit. The proximal end of the male catch 24 is snapped into a mating female member of the catch mechanism 22 which is molded into or attached to the distal end of the shaft 10 of the invention. The purpose of the mating catch mechanisms 22 and 24 is to provide a device for cleaning hair-clogs 36 (FIG. 1G) and other fibrous debris from a drain in which the hair-snagging pad 12 may be used and discarded with the retrieved debris. By releasing the catch 24, the combined pad 12 and male catch 24 unit are freed from the device for disposal and ready for another new pad 12 and catch 24 unit to be snapped into place. It will be apparent after examining the drawing in FIG. 2 that equivalent functionality may easily be envisioned and implemented to serve the same purpose for the female catch 22 and male catch 24. The depiction of these in the drawings shows a common buckle type snap-fit mechanism for illustrative purposes only to display the principle of the removable hair-snagging pad 12, and are not intended to limit the invention to the exact construction and operation shown. It is the intent of the present invention to encompass other equivalent functioning embodiments of the female catch 22 and male catch 24 that satisfy the purpose of their functionality of easy removal of the pad 12 within the context of the present, novel invention.

Additional Embodiments

FIG. 3

Figure 3:
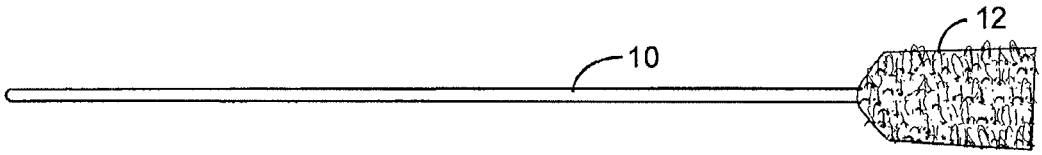
FIG. 3 is a perspective view of another very basic embodiment of this invention, which is simply a wire with a hair-snagging pad at the end.

FIG. 3 shows an additional embodiment of the invention. This embodiment is a stripped down version of the preferred embodiment, which may be manufactured even less expensively and may be desirable to the institutional user with many drains or the artisan who cleans drains professionally and has more interest in pure functionality than visual appeal. This embodiment consists of simply a #12, #14 or #16 size wire 14 or a plastic coated wire 14 with the attached hair-snagging pad 12. The distal end of the wire 14 is bent into some shape that has shoulders perpendicular to the wire 10 shaft, such as an oblong O-shape or a T-shape (not shown) and is then sealed inside the pad 12 pouch thermally, mechanically or with adhesives. By bending the end of wire 14, a shoulder is created which is perpendicular to the longitudinal axis of the wire 14 and which creates pull-out resistance of the wire 14 from the pouch 12. The proximal end of the wire 14 is left unbent for the user to insert into a drill or to manually bend into various grasping shapes such as a crank, O-shape or T-shape.

Figure 4A:
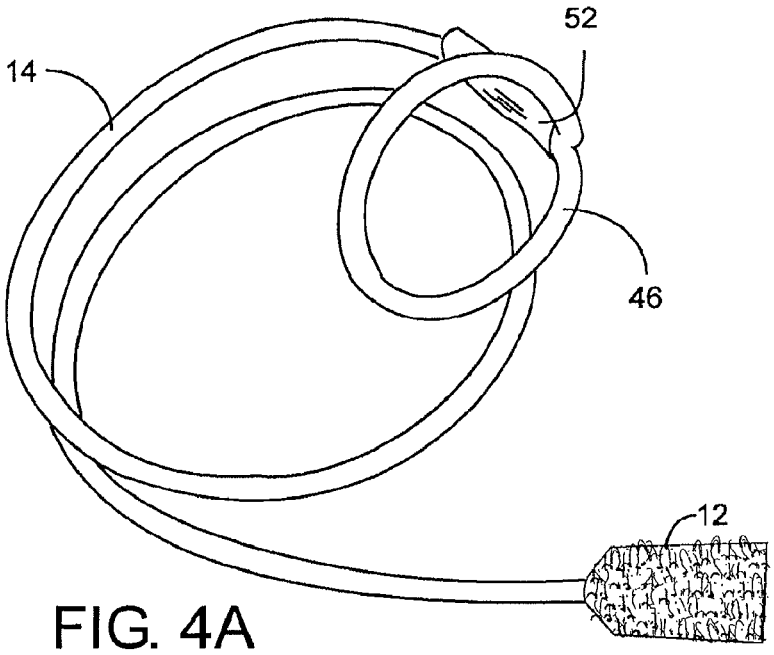
FIG. 4A is a perspective view of yet another embodiment of this invention in which the basic wire version of FIG. 3 has a plastic-coated wire instead of a bare wire and the grasping end has a circular bend.
Figure 4B:
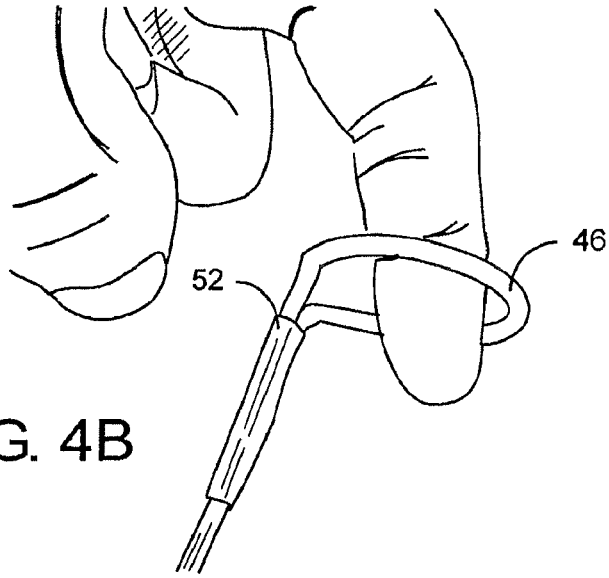
FIG. 4B is a close-up view of the proximal, grasping end of the embodiment shown in FIG. 4A, showing the method of operation utilizing the circular bend as a finger spin ring.

Additional Embodiments FIGS. 4A-4B

The embodiment of the invention shown in FIG. 4A is the same as described above in FIG. 3 except that the proximal grasping end of the wire 14 shaft is bent into a finger spin ring 46 loop which may act either as a grasping handle or a means to rotate the shaft by insertion of the finger in a stirring motion as noted below in the operational description of this embodiment and depicted in FIG. 4B. The finger spin ring 46 is created by bending wire 14 on the proximal end into an O-shape while leaving a length of extra wire at the proximal end for twisting back around the wire 14 shaft at the base of the finger spin ring 46 and then covering the lapped extra length of wire 14 (not shown) and wire 14 shaft with a wire lap cover 52 made from a piece of heat-shrink PVC plastic approximately 3.81 cm or 1.5 inches long.

Additional Embodiments

FIGS. 5A-5E

Figure 5C:
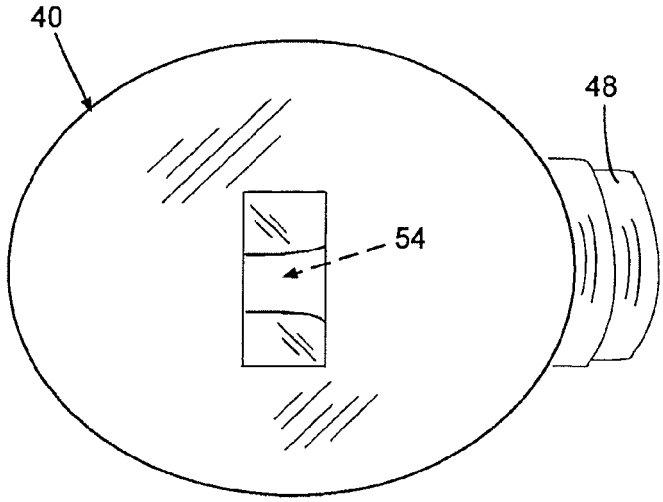
FIG. 5C is a close-up end view of the removable handle of the embodiment shown in FIG. 5A displaying the opening for inserting the wire shaft, and also showing the release button used for inserting and removing the wire shaft with pad.
Figure 5D:
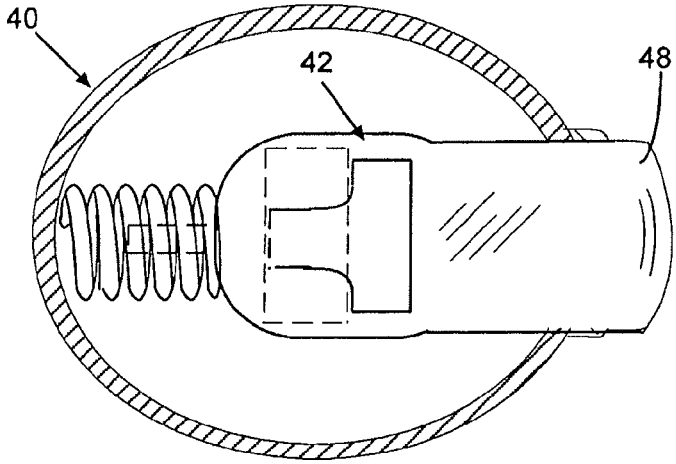
FIG. 5D also shows the embodiment of 5A but as a close-up sectional view of the end of the removable handle revealing the release mechanism inside in the locked position when the release button is not pushed.
Figure 5E:
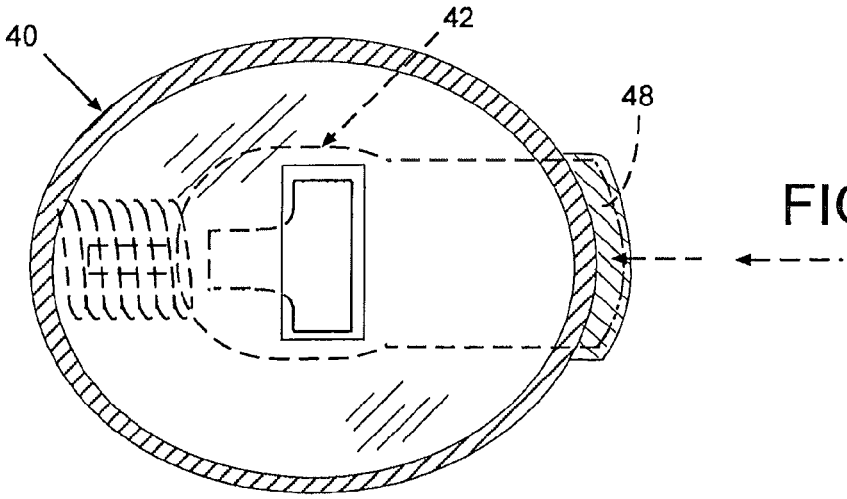
FIG. 5E is also a close-up end view of the removable handle embodiment of FIG. 5A except with the release button pushed into the release position.

FIGS. 5A-5E show another embodiment of the invention. In this form, the embodiment of FIG. 4 is taken one additional step by adding a removable handle 40 to the device as shown in FIG. 5A and utilizing a loop bend 56 as seen in FIG. 5B at the proximal end of the wire 14 for preventing the wire 14 with pad 12 combined member from pulling out of the handle 40. The wire 14 may also be plastic coated. Once again this embodiment is targeted toward the professional artisan or institutional user who desires the same functionality of the preferred embodiment of the device, but regards per-use, reduced cost and utility of greatest importance. This embodiment retains the novel and effective double-sided snagging pad 12 and bendable memory of the wire 14 to coil the replaceable wire 14 with pad 12 combined members into a compact size for portability and packaging along with the handle 40. The waterproof PVC sheath 16 and plug 18 of the preferred embodiment are not found in this version of the device since it will not optionally be cleaned and reused, but rather the wire 14 with pad 12 will simply be disposed of after use. The removable handle 40 is preferably made of molded plastic with a handle release mechanism 42 as shown in FIGS. 5C-5E into which the wire 14 is slid and automatically locked in place. The wire 14 receiving end of the handle 40 has a vertical lock slot 54 as viewed in FIG. 5C into which the looped end of the wire 14 is inserted after pushing release button 48. FIG. 5C shows and end view of the handle 40 with the release button 48 in the out position. FIG. 5D shows a sectional end view of the handle 40 revealing the internal handle release mechanism 42 with the release button 48 in the out position. In this locked position, the loop bend 56 shown in FIG. 5B is unable to pull out through the smaller horizontal opening of the lock slot 54. FIG. 5E is a sectional view of the handle 40 with the release button 48 in the pushed-in position. With the release button 48 pushed in as shown in FIG. 5E, the vertical opening of the lock slot 54 is revealed, allowing the loop bend 56 end portion of wire 14 to be inserted or withdrawn from the handle 40. The wire 14 with pad 12 can be discarded after use.

The loop bend 56 in the wire 14 shown in FIG. 5B prevents the wire 14 shaft from spinning inside the handle 40 upon rotation of the device via the handle 40. It will be apparent after examining the drawing in FIG. 5 that equivalent functionality may easily be envisioned and implemented to serve the same purpose for the removable handle 40 and handle release mechanism 42. The depiction of these in the drawings are for illustrative purposes only to show the principle of the removable handle 40 and handle release mechanism 42 and not intended to limit the invention to the exact construction and operation shown. It is the intent of the present invention to encompass other equivalent functioning embodiments of the handle 40 and handle release mechanism 42 that satisfy the purpose of their functionality of a removable handle 40 and handle release mechanism 42 within the context of the present, novel invention.

Operation Common to All Embodiments

The device in its various embodiments as illustrated in FIGS. 1A, 1L, 2, 3, 4A and 5A is used to retrieve hair-clogs 36 shown in FIG. 1G and other fibrous debris from the upper portions of drains from the drain opening to the U-shaped trap. The flexible shaft 10 allows the device to be bent into many shapes that aid in grasping, pushing, pulling and rotating the device to navigate the drainpipe and snag clogs. For example, if the device comes to the user packaged in a coil, the user may simply uncoil the needed length to reach the hair-clog and grasp the remaining O-shaped uncoiled shaft as a handle as viewed in FIGS. 1C-1D. The proximal end of the shaft may also be bent into a T-shape handle for the same grasping convenience. A third option might be to bend the grasping proximal end into a Z-shape crank (not shown) and use both hands to crank the device, rotating the pad 12 within the drain like a rectangular paddle, sweeping and entangling the drain hair and other fibrous clogs. The 300 odd hooking members 38 on both sides of the hair-snagging pad 12 will aggressively entangle and hold the hair for retrieval of the clog.

Additional Operation of Embodiment in FIG. 1L

The embodiment of the device as represented in FIG. 1L operates in a very similar fashion to the other embodiments. The distal end of the device with the hair-snagging pad 12 is inserted into the drain and manipulated in an up and down or rotating motion to snag hair clogs 36 (FIG. 1G) suspended over the drain pop-up lever arm 34 or in the drain trap. This version of the device is simply held by the enlarged, molded plastic handle grasping member 58 located at the proximal end of the device while manipulating the device, or else the user's finger may be inserted in the hole of the grasping member 58 for pulling or rotation of the device.

Additional Operation of Embodiment in FIG. 2

The embodiment of the device as shown in FIG. 2 operates significantly the same as the embodiments illustrated in FIGS. 1A, 3, 4A and 5A as noted above with the exception that this embodiment has a removable pad 12 with male catch 24. After inserting, maneuvering, and withdrawing the device from the drain as stated above under operation common to embodiments in FIGS. 1A, 2, 3, 4A and 5A, the user simply pinches together the release arms of the male catch 24 to free the catch 24 and pad 12 for disposal along with the hair and fibrous waste retrieved from the drain. The user can then simply snap in a new, clean catch 24 with pad 12 unit. The shaft 10 with attached female catch 22 mechanism is purchased only once so that the user may buy the smaller and less expensive male catch 24 with pad 12 units in quantity for future drain maintenance.

Additional Operation of Embodiment in FIG. 3

In addition to the functionality described above under operation common to embodiments in FIGS. 1A, 2, 3, 4A and 5A, the embodiment of the invention as shown in FIG. 3 is designed to be purchased in quantities and disposable after each use. An optional mode of operation for this embodiment is to insert the proximal end of wire 14 into an electric drill for creating an automatic rotation motion of the hair-snagging pad 12 in the drain.

Additional Operation of Embodiment in FIG. 4A

In addition to the functionality described above under operation common to embodiments in FIGS. 1A, 2, 3, 4A and 5A, the embodiment of the invention as shown in FIGS. 4A and 4B is designed to be purchased in quantities and disposable after each use. An optional mode of operation for this embodiment is to rotate the shaft 10 with pad 12 by use of the finger spin ring 46. This allows the user to grasp the wire 14 lightly in one hand while inserting the index finger of the other hand into the ring 46 and rotating the whole device with a stirring motion of the finger along the inside surface of the ring 46 as shown in FIG. 4B.

Operation of Embodiment in FIG. 5A

The embodiment of the device as shown in FIG. 5A is used to retrieve hair-clogs and other fibrous debris from the upper portions of drains from the drain opening to the U-shaped trap. As shown in FIG. 5A, this embodiment of the invention has a removable handle 40 that aids in grasping, pushing, pulling and rotating the device to navigate the drainpipe and snag clogs. The wire 14 and snagging pad 12 are slid into the removable handle 40 and locked into place with the handle release mechanism 42 shown in FIGS. 5D-5E. The handle is then grasped for the inserting, pushing and pulling of the device required to navigate the drain and snag and remove hair and other fibrous clogs. The rotating pad 12 within the drain acts like a rectangular paddle, sweeping and entangling the drain hair and other fibrous clogs encountered within the drainpipe. The 300 odd hooking members 38 as shown in FIG. 1K, on both sides of the hair-snagging pad 12 will aggressively entangle and hold the hair for retrieval of the clog. After use, the release button 48 on the handle 40 is pressed allowing the wire 14 with attached pad 12 to slide out and be thrown in the trash with the accompanying hair and other fibrous waste that is snagged. The user is then ready to insert a new, clean wire 14 with pad 12 into the reusable handle 40. The handle is purchased only once and then the user need only buy the replacement wire 14 with attached pad 12 units in quantities for an inexpensive and convenient way to maintain drains on a regular basis. The operation of the handle release mechanism 42 will be apparent from viewing the drawings in FIGS. 5C-5E.

It is understood that the invention is not confined to the particular construction and arrangement of parts herein illustrated and described, but embraces such modified forms thereof as come within the scope of the following claims.

As can be seen from reviewing the drawings and descriptions above, the present invention in its various embodiments represent a new and novel device for retrieving hair-clogs and other fibrous debris from the upper portions of drains in the common household. Its advantages include:

- Being hand-held in size due to its coiling capability making it compact for packaging, storing and transporting;
- Unique hair-snagging surfaces made from the hook portion of common hook-and-loop material which maximizes the number of hooking members due to its 2-sided substantially rectangular-shaped pad configuration;
- Safe for the user since it has no sharp edges or metal hooks;
- Safe for people, pets and the environment by opening hair-clogged drains without the use of caustic chemical drain openers;
- Compact enough to be packaged with off-the-shelf biological, drain-opener products creating a totally new combined product offering that is a complete drain maintenance solution without the environmental and safety issues of chemical drain products;
- Inexpensive to manufacture from commonly available materials;
- Inexpensive to buy due to low cost of manufacture;
- Made from corrosion-resistance materials.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device for retrieving hair and other fibrous waste from a drain comprising:

(a) an elongate shaft, which flexes into fixed or compact bent positions, having a proximal end portion for grasping and a distal end portion for insertion into a drain, wherein the elongate shaft flexes to follow a shape of the drain and further flexes to a compact loop configuration for storage;

(b) a hair-snagging means reversibly connected to the distal end of the elongate shaft, wherein the hair-snagging means consists of a hook portion of common hook-and-loop fastener material; and (c) a reversible connecting mechanism for reversibly connecting the hair-snagging means to the distal end of the elongate shaft.

2. The device of claim 1 wherein the reversible connecting mechanism includes a snap-fit mechanism.

3. The device of claim 2 wherein the snap-fit mechanism comprises:

(a) a male catch member on either the hair-snagging means or the distal end; and (b) a female member on either the distal end or the hair-snagging means, respectively, wherein the male member reversibly snaps into the female member to secure the hair-snagging means to the distal end.

4. The device of claim 1 wherein the shaft comprises molded plastic.

5. The device of claim 1 wherein the shaft comprises a metallic member.

6. The device of claim 1 wherein the shaft includes a metallic member encased in plastic.

7. The device of claim 6 wherein the metallic member in the elongate shaft is only a single strand of wire.

8. The device of claim 1 wherein the hair-snagging means includes a substantially flat, double-faced pad or pouch, and the hook portion of the common hook-and-loop fastener material extends from both surfaces of the pad or pouch.

9. The device of claim 1 further including a plug inserted in the proximal end of the shaft to seal the shaft.

10. The device of claim 1 wherein the proximal end of the shaft is bent into a loop.

11. A device for retrieving hair and other fibrous waste from a drain comprising:

(a) an elongate shaft comprised of molded plastic and having a proximal end portion for grasping and a distal end portion for insertion into a drain, wherein the elongate shaft flexes to follow a shape of the drain and further flexes to a compact loop configuration for storage;

(b) a hair-snagging means located at the distal end of the elongate shaft, wherein the hair-snagging means consists of a hook portion of common hook-and-loop fastener material; and (c) a grasping member located on the proximal end of the elongate shaft.

12. The device of claim 11 wherein the grasping member includes a loop portion of common hook-and-loop fastener material for attaching to the hook portion to maintain the elongate shaft in the compact loop configuration for storage.

13. The device of claim 11 wherein the grasping member includes a slot configured and dimensioned to accept the hair-snagging means and the elongate shaft therethrough and to snugly hold the elongate shaft therein to maintain the elongate shaft in the compact loop configuration for storage.

14. The device of claim 11 wherein the hair-snagging means includes a substantially flat, double-faced pad or pouch, and the hook portion of the common hook-and-loop fastener material extends from both surfaces of the pad or pouch.

15. A device for retrieving hair and other fibrous waste from a drain comprising:

(a) an elongate shaft, which flexes into fixed or compact bent positions, having a proximal end portion for grasping and a distal end portion for insertion into a drain, wherein the elongate shaft flexes to follow a shape of the drain and further flexes to a compact loop configuration for storage;

(b) a hair-snagging means located at the distal end of the elongate shaft, wherein the hair-snagging means consists of a hook portion of common hook-and-loop fastener material; and (c) a removable handle with a release mechanism for receiving and releasing the proximal end of the elongate shaft whereby the elongate shaft and the hair-snagging means may be replaced with a clean elongate shaft and hair-snagging means after use.

16. The device of claim 15 wherein the proximal end of the elongate shaft includes a loop and the release mechanism includes a vertical lock slot for receiving and releasing the loop.

17. The device of claim 15 wherein the shaft comprises molded plastic.

18. The device of claim 15 wherein the shaft comprises a metallic member encased in the molded plastic.

19. The device of claim 18 wherein the metallic member in the elongate shaft is only a single strand of wire.

20. The device of claim 15 wherein the hair-snagging means includes a substantially flat, double-faced pad or pouch, and the hook portion of the common hook-and-loop fastener material extends from both surfaces of the pad or pouch.

* * * * *